US008053993B2

(12) United States Patent
Brockmann

(10) Patent No.: US 8,053,993 B2
(45) Date of Patent: Nov. 8, 2011

(54) LIGHTING CONTROL CONSOLE FOR CONTROLLING A LIGHTING SYSTEM AND METHOD FOR OPERATING A LIGHTING CONTROL CONSOLE

(75) Inventor: Thomas Brockmann, Copenhagen (DK)

(73) Assignee: MA Lighting Technology GmbH, Waldbüttelbrunn (DE)

( * ) Notice: Subject to any disclaimer, the term of this patent is extended or adjusted under 35 U.S.C. 154(b) by 438 days.

(21) Appl. No.: 12/212,491

(22) Filed: Sep. 17, 2008

(65) Prior Publication Data

US 2010/0001665 A1 Jan. 7, 2010

(30) Foreign Application Priority Data

Jul. 2, 2008 (DE) ..... 10 2008 030 920

(51) Int. Cl.
*H05B 39/04* (2006.01)
*H05B 37/00* (2006.01)

(52) U.S. Cl. ..... 315/149; 315/150

(58) Field of Classification Search ..... 315/129–134, 315/149–151, 312
See application file for complete search history.

(56) References Cited

U.S. PATENT DOCUMENTS

| | | | | |
|---|---|---|---|---|
| 6,020,825 | A | 2/2000 | Chansky et al. | |
| 6,724,368 | B2 * | 4/2004 | Strubbe | 345/158 |
| 6,761,470 | B2 | 7/2004 | Sid | |
| 7,102,616 | B1 * | 9/2006 | Sleator | 345/158 |
| 7,355,523 | B2 * | 4/2008 | Sid | 340/825.52 |
| 7,405,715 | B2 * | 7/2008 | Guzman et al. | 345/83 |
| 7,566,858 | B2 * | 7/2009 | Hotelling et al. | 250/208.2 |
| 7,748,878 | B2 * | 7/2010 | Lee | 362/386 |
| 2004/0141321 | A1 * | 7/2004 | Dowling et al. | 362/276 |
| 2005/0030179 | A1 * | 2/2005 | Script et al. | 340/545.1 |
| 2005/0132408 | A1 * | 6/2005 | Dahley et al. | 725/80 |
| 2009/0026978 | A1 * | 1/2009 | Robinson | 315/294 |
| 2009/0144646 | A1 * | 6/2009 | Reese | 715/771 |
| 2009/0241052 | A1 * | 9/2009 | Ha et al. | 715/772 |

FOREIGN PATENT DOCUMENTS

| | | | |
|---|---|---|---|
| DE | 202006007141 | U1 | 10/2006 |
| EP | 0457541 | A1 | 11/1991 |
| WO | 2006/038135 | A1 | 4/2006 |
| WO | 2006/120596 | A2 | 11/2006 |

* cited by examiner

*Primary Examiner* — Douglas W Owens
*Assistant Examiner* — Minh D A
(74) *Attorney, Agent, or Firm* — Quarles & Brady LLP

(57) ABSTRACT

A lighting control console for controlling a lighting system, wherein digital adjusting commands are generated in the lighting control console, which can be transferred to the lighting devices of the lighting system via data connections, and wherein the lighting control console comprises at least one digital processor and at least one digital memory for generating, managing and storing the adjusting commands, and wherein the lighting control console comprises a remote control, and wherein operator inputs can be input at the remote control and can thereafter be transferred to the lighting control console via a data interface, and wherein at least one motion sensor, by means of which motions of the remote control can be detected, is installed in the remote control, wherein the sensor signals of the motion sensor can be evaluated in an evaluation module and can be transformed into operator inputs for the lighting control console.

11 Claims, 1 Drawing Sheet

LIGHTING CONTROL CONSOLE FOR CONTROLLING A LIGHTING SYSTEM AND METHOD FOR OPERATING A LIGHTING CONTROL CONSOLE

CROSS-REFERENCE TO RELATED APPLICATION

This application claims the priority benefit of German Patent Application No. 10 2008 030 920.6 filed on Jul. 2, 2008, the contents of which are hereby incorporated by reference as if fully set forth herein in their entirety.

STATEMENT CONCERNING FEDERALLY SPONSORED RESEARCH OR DEVELOPMENT

Not applicable.

FIELD OF THE INVENTION

The invention relates to a lighting control console for controlling a lighting system in which digital adjusting commands are generated in the lighting control console. The digital adjusting commands can be transferred to the lighting devices of the lighting system via data connections. The lighting control console comprises at least one digital processor and at least one digital memory for generating, managing and storing the adjusting commands. The lighting control console further comprises a remote control, wherein operator inputs can be input at the remote control and can thereafter be transferred to the lighting control console via a data interface.

The invention further relates to a method for operating such a lighting control console.

BACKGROUND OF THE INVENTION

Generic lighting control consoles serve the purpose of controlling lighting systems, such as they are used in theaters or concert stages, for example. Routinely, these lighting systems comprise a plurality of lighting devices, for example stage spotlights, wherein the lighting devices on their own can in many cases be changed between a plurality of lighting states, for example different colors. These different lighting states of the different lighting devices are stored and controlled in the lighting program of the lighting control console by means of programmed parameters.

Known lighting systems can thereby comprise up to several thousands of lighting devices. To be able to control such complex lighting systems, generic lighting control consoles are equipped with a digital processor, which allows for a digital data and signal processing. To store the program data, provision is furthermore made for a digital memory, which makes it possible in particular to archive lighting programs.

To program the lighting program and to control the lighting program during its application flow, respectively, the operator must input the most different operating commands. These may be, for example, the selection of a certain lighting device and the setting of a certain lighting parameter, respectively. To input these operating commands, mechanical operating elements, for example push-buttons, rotary controls or slide controls are available at the known lighting control consoles. The operating commands assigned to the individual operating elements can thereby be changed by means of suitable menu changeovers so as to be able to program and control complex lighting programs appropriately.

To provide the user of the lighting control console with more mobility when inputting operating commands, provision was made for lighting control consoles, which can also be controlled via a remote control. The user thus has the ability to also be able to input operator inputs at the remote control. These user inputs input at the remote control are subsequently transferred to the lighting control console via a data interface and are processed appropriately at that location. For the most part, the operating concept of the known remote controls thereby corresponds to the operating concept of the input elements at the lighting control console. This means that provision is again made for push-buttons, rotary controls or slide controls for the known remote controls, so as to be able to input the operator inputs. These operating elements can thereby also be realized on a touch screen by means of corresponding symbolization, for example.

The disadvantage of the known utilization concept with regard to the input of operator inputs at a remote control is that a largely intuitive input of the operator inputs is not possible. In many cases, the remote controls are furthermore relatively small so as to enable the mobility of the remote control so that the typical operating elements can be installed and illustrated, respectively, on the remote control only in a very small size.

SUMMARY OF THE INVENTION

Based on this state of the art, it is thus the object of the present invention to provide a new lighting control console comprising a remote control, which realizes a new operating concept, which can be used intuitively.

It is furthermore the object of the invention to provide a method for operating a lighting control console for realizing this intuitive operating concept.

One embodiment of a lighting control console incorporating the invention is based on the basic idea of installing at least one motion sensor into the remote control, by means of which motions of the remote control can be detected. The sensor signals of the motion sensor, which thus represent the motion of the remote control, can then be evaluated in an evaluation module and can be transformed into operator inputs for the lighting control console. In other words, this means that the user can input his operator inputs by means of motions which are transferred to the remote control without having to use specific operating elements for this purpose. Different operator inputs can thereby in each case be assigned to different directions of motion, speeds of motion and/or accelerations of motion and to the different types of motion, respectively. In the end, this is a question of the programming of the evaluation module.

It is generally optional where the sensor signals of the motion sensor are evaluated. It is thus indeed possible that the sensor signals are transferred to the lighting control console via the data interface by means of the remote control and that they are evaluated there in an evaluation module, which is integrated into the lighting control console, and that they are transformed into operator inputs. However, so as to have to make the least possible amount of changes at the structuring of the known lighting control consoles, it is advantageous when the evaluation module is integrated into the remote control so that the sensor signals of the motion sensor are already evaluated within the remote control and are transformed into operator inputs. In so doing it is then possible to transfer the operator inputs to the lighting control console via a data interface in the known manner so that it is not necessary to make changes at the lighting control console itself to the programming in order to receive the operator inputs of the remote control.

It is generally optional how the data are transferred between the remote control and the lighting control console.

To enable the highest possible mobility and to enable a correspondingly large breadth of variation for inputting motion-bound operator inputs, provision should preferably be made for a wireless data interface between remote control and lighting control console.

Provision can be made for a data transfer module, in particular a WLAN module, in the remote control for a wireless data transfer.

The design of the motion sensors in the remote control is generally optional, wherein the motion sensors must generally be matched to the operating concept for inputting operating commands at the remote control. According to a first embodiment, at least one translation sensor is installed in the remote control, by means of which translation sensor translational motions of the remote control can be detected along an axis of motion. These translation sensors can be acceleration sensors, for example, which are preferably realized on a semiconductor.

To be able to completely hold the translational motions of the remote control in the three-dimensional space, it is particularly advantageous when the remote control encompasses three translation sensors, each of which are assigned to axes of motion, for example orthogonally arranged x, y and z axes, which are independent of one another.

Rotation sensors can also be installed into the remote control so as to also be able to detect tilting and pivoting motions of the remote control.

A complete detection of all of the rotational motions of the remote control in the three-dimensional space is possible when three rotation sensors are installed in the remote control, which are assigned to axes of rotation, for example the rotation about the x-axis, the rotational motion about the y-axis and the rotational motion about the z-axis, which axes of rotation are independent of one another.

In the method for operating a lighting control console incorporating the invention, the motion of the remote control is initially detected by means of a motion sensor. Subsequently, the sensor signals of the motion sensor, which represent the motions of the remote control in the three-dimensional space, are evaluated in an evaluation module and are transformed into an operator input for the lighting control console, which is assigned to the motion.

It is generally optional how the operator inputs transformed from the sensor signals of the motion sensor are further processed. According to a preferred main alternative embodiment of the invention, this motion-controlled operator input is converted into a digital adjusting command for controlling a lighting device of the lighting system.

It is generally optional which type of operator inputs are carried out. According to a preferred alternative, a motion of the remote control, in particular a translational motion, can initiate a change of the lighting intensity of at least one lighting device of the lighting system. As a result, the user is then able to change the lighting intensity of one lighting device and/or of a plurality of lighting devices by means of an intuitive motion of the remote control.

According to a second method alternative, the motions of the remote control are transformed for controlling and changing, respectively, the lighting direction of at least one lighting device of the lighting system. In many cases, known lighting devices have two adjusting axes, about which the lighting device can be pivoted (pan/tilt). These steering axes of the lighting devices can be controlled intuitively in particular by evaluating tilting motions of the remote control.

According to a further method alternative, provision is made for the light color of at least one lighting device to be capable of being changed by means of motions of the remote control.

According to a further method alternative it is furthermore possible to use the motions of the remote control to control the optical aperture at a lighting device.

An embodiment of the invention is illustrated diagrammatically in the drawing and is defined below in an exemplary manner.

DETAILED DESCRIPTION OF THE EXAMPLE EMBODIMENT

Figure 1:
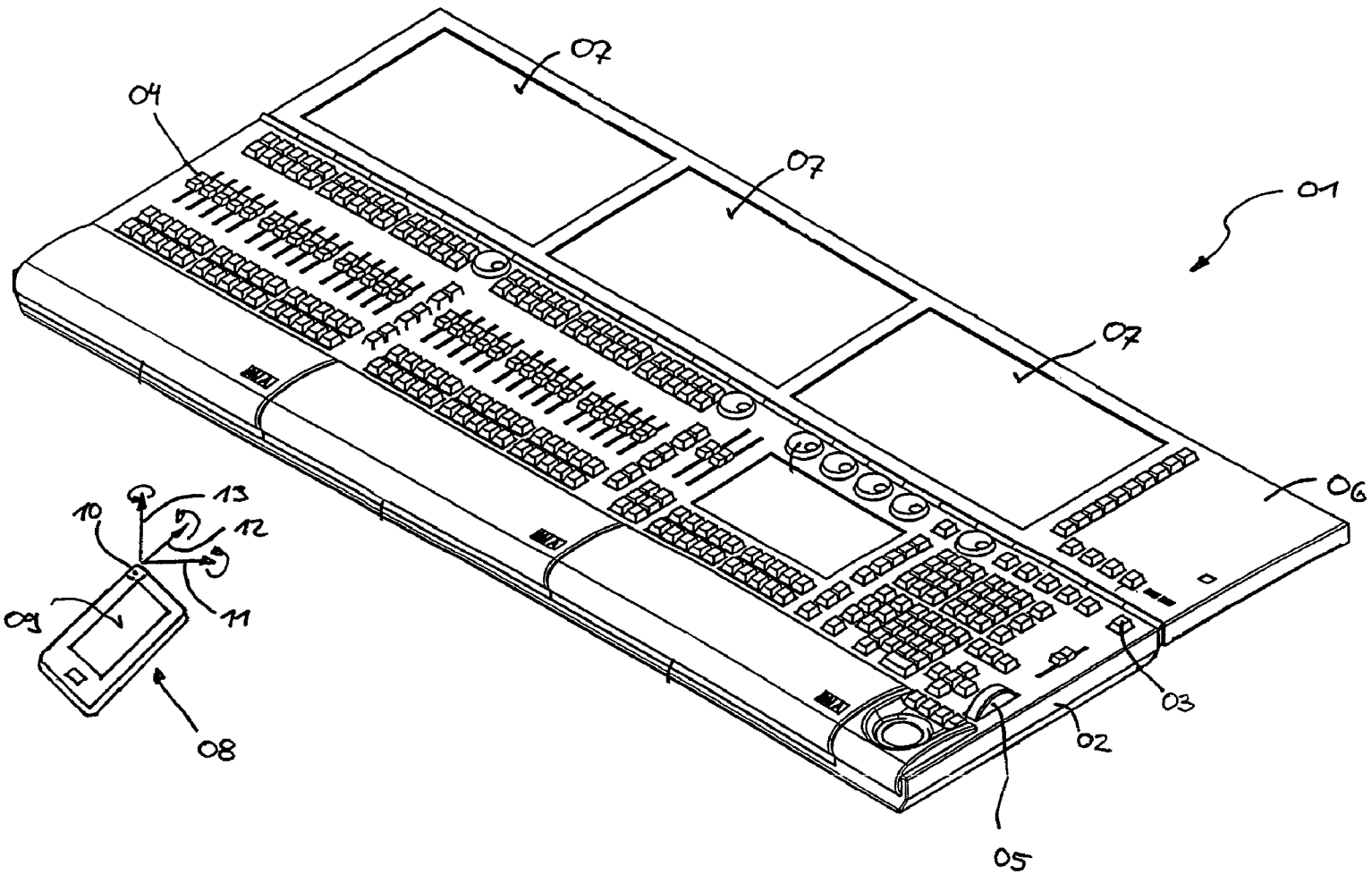
FIG. 1 shows a lighting control console comprising a remote control in a perspective view.

FIG. 1 shows a lighting control console 01 for controlling a non-illustrated complex lighting system. A plurality of digital processors and digital memories for generating, processing and storing digital adjusting commands are thereby arranged in the housing 02. A plurality of operating elements, namely push-buttons 03, slide controls 04 and rotary controls 05, are located at the top side of the housing 02. Furthermore, the lighting control console 01 is equipped with a pivotable support 06, at which provision is made for three contact-sensitive display devices 07.

The operating elements, namely the push-buttons 02, the slide controls 04 and the rotary controls 05, serve the purpose of inputting operating commands into the lighting control console 01. Operating commands can furthermore also be input at a remote control 08. The remote control 08 can thereby exchange data with the lighting control console 01 via a wireless data interface, for example via WLAN. Provision is made at the upper side of the remote control 08 for a display device 09, which can display a menu navigation to the user.

A motion sensor 10, with which translational motions of the remote control 08 along the three axes of motion 11, 12 and 13 (x-axis, y-axis and z-axis) can be detected, are integrated into the remote control 08. Furthermore, the motion sensor 10, which can be configured from six different sensor units, for example, also enables the detection of rotational motions about the three axes of motion 11, 12 and 13 so that a complete determination of all of the motions of the remote control 08 in the three-dimensional space is possible by means of the evaluation of the sensor signals of the motion sensor 10. A non-illustrated evaluation module, in which the sensor signals of the motion sensor 10 are evaluated, such as to determine a direction of motion of the remote control and/or acceleration of the motion of the remote control, and transformed into operator inputs, such as for changing lighting intensity, the lighting direction, the light color or the optical aperture of lighting devices controlled by the console 01, is furthermore integrated into the remote control 08. In one embodiment, the evaluation module can consist of software operating on a digital processor in the remote control. These motion-controlled operator inputs are subsequently transferred to the lighting control console 01 in a wireless manner so as to change and program, respectively, the lighting intensity, the lighting direction, the light color or the optical aperture of lighting devices.

While there has been shown and described what are at present considered the preferred embodiment of the invention, it will be obvious to those skilled in the art that various changes and modifications can be made therein without departing from the scope of the invention defined by the appended claims. Therefore, various alternatives and embodiments are contemplated as being within the scope of the following claims particularly pointing out and distinctly claiming the subject matter regarded as the invention.

The invention claimed is:

1. A lighting control system for controlling a lighting system, said lighting control system comprising:

a lighting control console, wherein digital adjusting commands are generated in the lighting control console and transferred to the lighting devices of the lighting system via data connections, wherein-the lighting control console comprises at least one digital processor and at least one digital memory for generating, managing and storing the digital adjusting commands; and a remote control, wherein operator inputs input at the remote control are transferred to the lighting control console via a data interface, the remote control including at least one acceleration sensor sensing motions of the remote control and generating sensor signals, wherein the sensor signals generated by the motion sensor are evaluated in an evaluation module and transformed into operator inputs controlling the lighting devices of the lighting system, wherein at least one rotation sensor is installed into the remote control, by means of which rotational motions of the remote control about an axis of motion can be detected, a rotational motion of the remote control detected by the at least one rotation sensor is transformed in the evaluation module into an operator input for changing the lighting direction (PAN/TILT) of at least one lighting device of the lighting system.

2. The lighting control system according to claim 1, in which the evaluation module is integrated into the remote control and the operator inputs derived from the sensor signals of the acceleration sensor are transferred to the lighting control console via the data interface.

3. The lighting control system according to claim 1, in which the data interface between remote control and lighting control console enables a wireless data transfer.

4. The lighting control system according to claim 3, in which provision is made in the remote control for a data transfer module, in particular a WLAN module, for wireless data transfer of data to the lighting control console.

5. The lighting control system according to claim 1, in which at least one translation sensor is installed into the remote control, by means of which translational motions of the remote control along an axis of motion can be detected.

6. The lighting control system according to claim 5, in which the at least one translation sensor comprises three sensor elements, by means of which translational motions of the remote control along three axes of motion, which are independent of one another, can be detected.

7. The lighting control console according to claim 1, in which the at least one rotation sensor comprises three sensor elements, by means of which rotational motions of the remote control about three axes of motion, which are independent of one another, can be detected.

8. A method for operating a lighting control console provided for controlling a lighting system, wherein digital adjusting commands are generated in the lighting control console, which commands can be transferred to the lighting devices of the lighting system via data connections, and wherein the lighting control console comprises at least one digital processor and at least one digital memory for generating, managing and storing the adjusting commands, wherein operator inputs input at a remote control are transferred to the lighting control console via a data interface, said method comprising:

a) detecting a motion of the remote control by means of an acceleration sensor which generates sensor signals;

b) evaluating the sensor signals of the motion sensor in an evaluation module; and c) transforming the sensor signals into an operator input for the lighting control console controlling lighting devices of the lighting system wherein digital adjusting commands for controlling a lighting device of the lighting system are generated from the operator inputs, which are derived from the sensor signals of the acceleration sensor; and a rotational motion of the remote control is transformed in the evaluation module into an operator input for changing the lighting direction (PAN/TILT) of at least one lighting device of the lighting system.

9. The method according to claim 8, in which a motion of the remote control, in particular a translational motion, is transformed in the evaluation module into an operator input for changing the lighting intensity of at least one lighting device of the lighting system.

10. The method according to claim 8, in which a motion of the remote control is transformed in the evaluation module into an operator input for changing a light color of at least one lighting device of the lighting system.

11. A method for operating a lighting control console provided for controlling a lighting system, wherein digital adjusting commands are generated in the lighting control console, which commands can be transferred to the lighting devices of the lighting system via data connections, and wherein the lighting control console comprises at least one digital processor and at least one digital memory for generating, managing and storing the adjusting commands, wherein operator inputs input at a remote control are transferred to the lighting control console via a data interface, said method comprising:

a) detecting a motion of the remote control by means of an acceleration sensor which generates sensor signals;

b) evaluating the sensor signals of the motion sensor in an evaluation module; and c) transforming the sensor signals into an operator input for the lighting control console controlling lighting devices of the lighting system wherein digital adjusting commands for controlling a lighting device of the lighting system are generated from the operator inputs, which are derived from the sensor signals of the acceleration sensor; and a motion of the remote control is transformed in the evaluation module into an operator input for changing an optical aperture of at least one lighting device of the lighting system.

* * * * *